US008387182B2

(12) United States Patent
Edelman

(10) Patent No.: US 8,387,182 B2
(45) Date of Patent: Mar. 5, 2013

(54) DEVICE FOR HANGING A HOLSTER ALONG A MATTRESS

(76) Inventor: David Edelman, Philadelphia, PA (US)

( * ) Notice: Subject to any disclaimer, the term of this patent is extended or adjusted under 35 U.S.C. 154(b) by 327 days.

(21) Appl. No.: 12/634,112

(22) Filed: Dec. 9, 2009

(65) Prior Publication Data

US 2011/0132943 A1 Jun. 9, 2011

(51) Int. Cl.
*A47C 21/00* (2006.01)

(52) U.S. Cl. ..... 5/503.1; 5/508; 248/201; 248/205.1; 224/912; 224/243

(58) Field of Classification Search ..... 5/503.1, 5/508; 248/201, 205.1; 224/912, 243
See application file for complete search history.

(56) References Cited

U.S. PATENT DOCUMENTS 4,461,442 A 7/1984 Keenan
4,521,930 A 6/1985 Henson
4,691,396 A 9/1987 Hoffman
5,111,545 A 5/1992 Krozal
8,074,477 B1 * 12/2011 Weiche ..... 5/658

* cited by examiner

*Primary Examiner* — Robert G Santos
*Assistant Examiner* — Brittany Wilson
(74) *Attorney, Agent, or Firm* — Drinker Biddle & Reath LLP

(57) ABSTRACT

This application discloses a device for hanging a holstered handgun along a side of a mattress. The device includes a plate member to be inserted between the underside of the mattress and the supporting surface below the mattress, wherein the side adapted to extend outward from the mattress has a pair of spaced apart hinge barrels each adapted to receive a hinge pin. Another piece of the device is a basket member to receive a handgun holster, wherein the basket member has a hinge pin extending from each lateral side adapted to couple into hinge barrel of the plate member. In a preferred embodiment, the front side of the basket member has a slot for interlocking with a tab on a handgun holster. The tab is preferably located on a belt loop device attachable to a holster.

9 Claims, 4 Drawing Sheets

DEVICE FOR HANGING A HOLSTER ALONG A MATTRESS

RELATED APPLICATIONS

This application does not claim priority from any other application.

FIELD OF THE INVENTION

The invention relates to the general field of handgun holsters, and to the more specific field of devices for hanging handguns or holsters along the side of a bed.

BACKGROUND OF THE INVENTION

Situations may arise in home and personal defense when a handgun must be readily accessible even while sleeping. Consequently, there have been devices to hang a handgun or holster along the side of a bed. Examples of such devices may be seen in the following patents: U.S. Pat. No. 4,461,442 (Keenan); U.S. Pat. No. 4,521,930 (Henson); U.S. Pat. No. 4,691,396 (Hoffman) and U.S. Pat. No. 5,111,545 (Krozi).

SUMMARY OF THE INVENTION

This invention is intended to improve upon the prior devices for hanging a holster along a mattress. It is similar to prior art holster hangers in that it uses a member which extends between the mattress and in that the mattress support (i.e. box spring set or other support structure) and the holster is cantilevered in some manner from the member. However, this invention differs from the prior devices in ways that add useful features, as explained herein.

In one aspect, this device for hanging a holstered handgun along a side of a mattress has two main parts, (1) a plate adapted for insertion between the underside of the mattress and the supporting surface below the mattress, wherein the side of the plate which extends outward from the mattress has a pair of spaced apart hinge barrels, and (2) a basket to receive a handgun holster, wherein the basket has hinge pins adapted to couple into hinge barrels of the plate. An associated aspect is that the basket may have fins associated with the hinge pins to inhibit the pins from being pulled out of the hinge barrels when the basket is in a cantilevered position with respect to the plate, but allows the pins to be pulled out of the hinge barrels when the basket is rotated into the plane of the plate.

In another aspect, the plate has a paddle section to increase its area. An aspect associate with this feature is that the paddle section has a cutout corresponding to the profile of the basket. In any configuration, the plate can have barb projections to snag into the mattress support when there is weight on the mattress to keep the plate from sliding out from under the mattress.

Another aspect is that the front side of the basket has a slot for locking a holster into the basket. The slot is adapted to have a conforming interlock fit with a tab on a handgun holster, so that the holster "snaps in" to the basket. The tab must be pressed back out of the slot to remove the holster.

Related to the above feature is a belt loop device provided with a holster hanger kit. The belt loop device has a support panel to attach to a holster, and has a flexible hook extending from its top portion, and the "snap-in" tab on a lower portion. This combination is particularly suited for use with a soft case holster, where the loop panel can be stitched into or adhered to the soft case material. The holster can be worn on a waist belt during personal carry and snapped into the mattress holder when sleeping.

All of the pieces are preferably made as lightweight high-density plastic parts. The forgoing and other advantages of the invention should be better understood upon considering the detailed description in respect to the drawings provided herein.

BRIEF DESCRIPTION OF THE DRAWINGS

For the purpose of illustration the invention, the drawings show various forms that are presently preferred. However, the invention is not limited to the precise constructions illustrated.

DETAILED DESCRIPTION OF THE EMBODIMENTS SHOWN IN THE DRAWINGS

Figure 1:
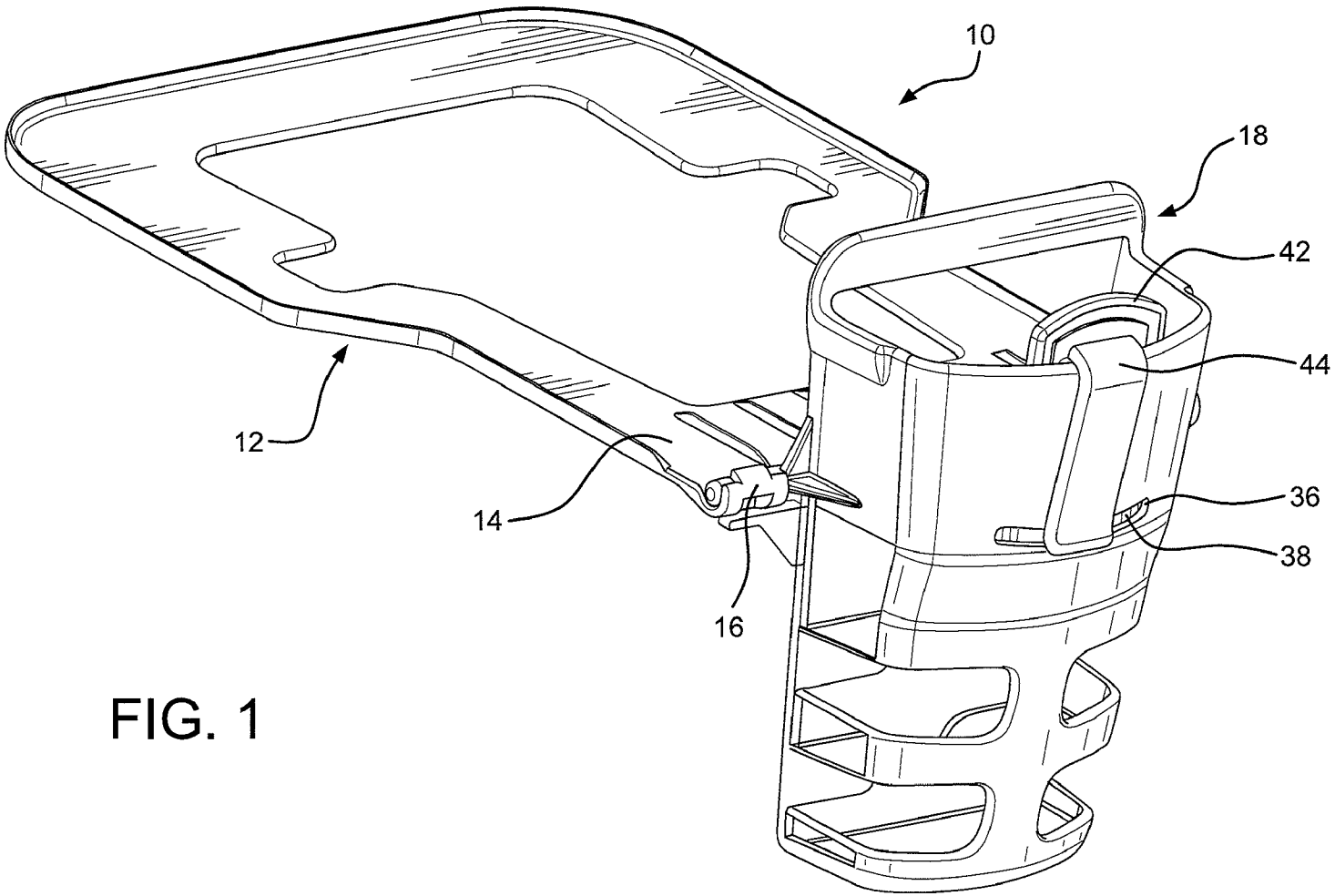
FIG. 1 is a left front perspective view of a device hanging a holstered handgun along a side of a mattress according to an embodiment of this invention.

Referring to FIG. 1, a device (10) is shown for hanging a holstered handgun along a side of a mattress. The device includes a plate member (12) adapted for insertion between an underside of the mattress and a supporting surface below the mattress (i.e., a box spring set or other support structure). The plate member (12) has a side (14) adapted to extend outward from the mattress and its supporting surface, on which side are located a pair of spaced apart hinge barrels (16) adapted to receive a hinge pin.

Figure 2:
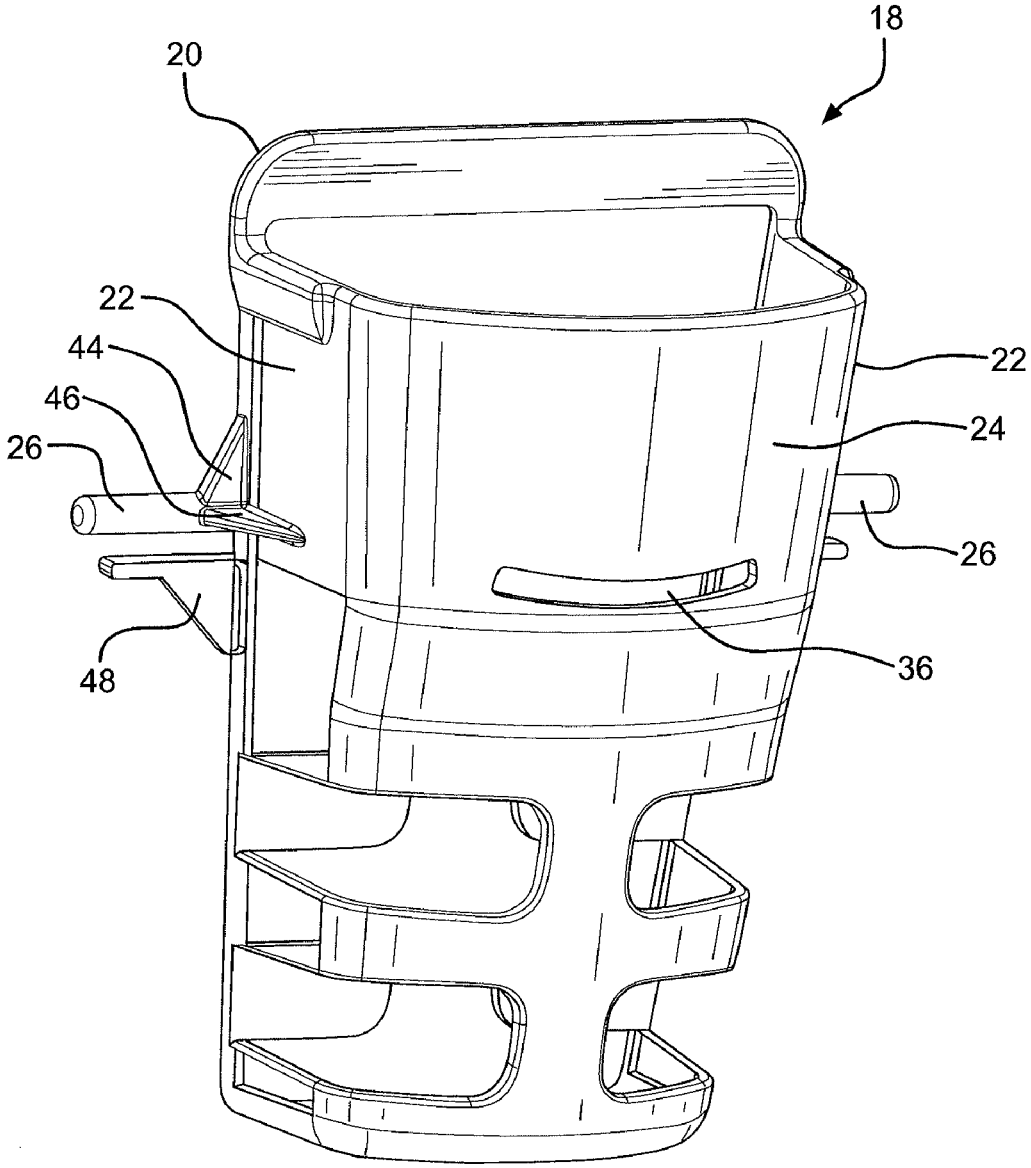
FIG. 2 is a view of a front left view of the basket member.

The device (10) also includes a basket member (18) adapted to receive a handgun holster (not shown). As shown in FIG. 2, the basket member (18) has a mattress facing side (20), two lateral sides (22) and a front side (24) that is opposite the mattress facing side. A hinge pin (26) extends from each lateral side (22). The hinge pins (26) are adapted to couple into the hinge barrels (16) of the plate member (12).

Figure 3:
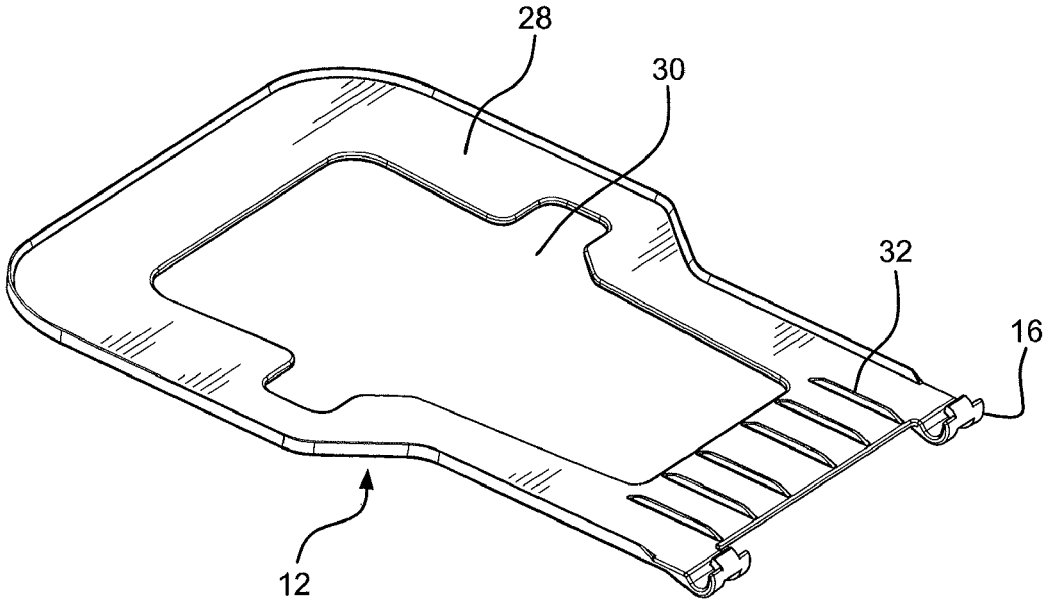
FIG. 3 is a view of the top face of the plate member.

Referring to FIG. 3, the top surface of the plate member (12) has a paddle section (28) to increase the support area. The paddle section preferably has a has a cutout section (30) which corresponds to the profile of the basket member (18) such that the basket member can be packaged within the cutout of the plate member in a blister pack. The top surface of the plate member (12) may also include raised ribs (32) along the side (14) adapted to extend outward from the mattress to inhibit the device from sliding.

Figure 4:
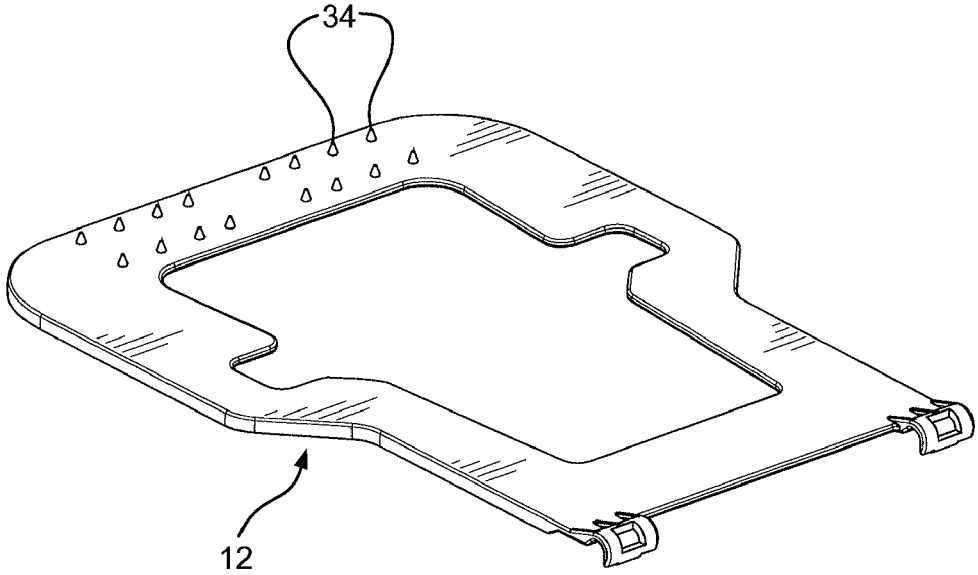
FIG. 4 is a view of the bottom face of the plate member.

Referring to FIG. 4, the bottom surface of the plate member (12) may have barb projections (34) adapted to snag the support surface below the mattress to inhibit the device from being pulled out from between the mattress and its support.

Figure 5:
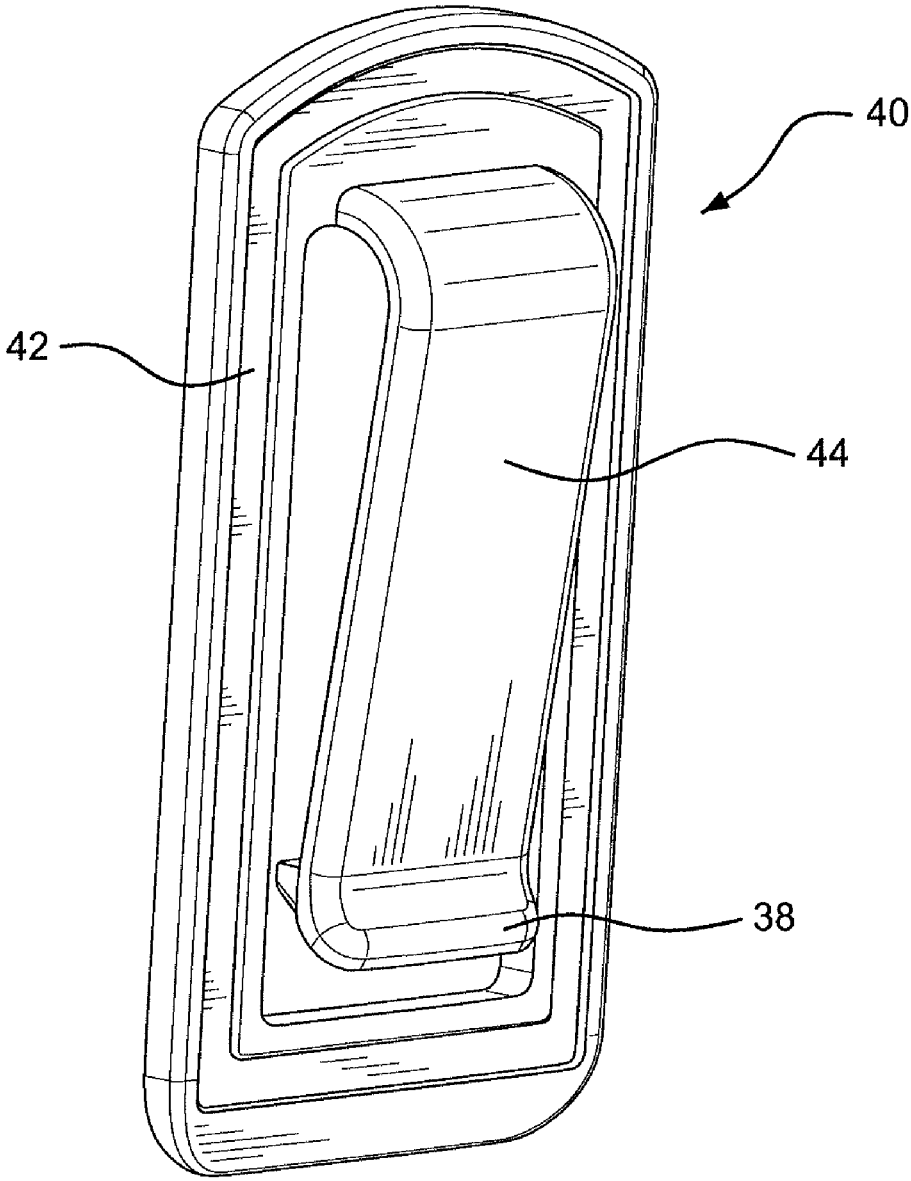
FIG. 5 is a left front view of the belt loop device.

As shown in FIG. 2, the front side (24) of the basket member has a lateral slot (36) adapted receiving a tab of a handgun holster in an interlocking fit. FIG. 1 shows the slot (36) engaged by a tab (38) associated with a holster. In the embodiment shown in FIGS. 1 and 5, the tab (38) is provided on a belt loop device (40) that can be attached to a holster. Thee belt loop device (40) includes a support panel (42) that has a with a flexible belt hook (44) extending from a top portion of the panel. The tab (38) extends from a lower portion of the panel, and is adapted for a conforming interlock fit into the slot (36) of the basket member. The belt loop device (40) may be sold with the holster hanging device (10) as a kit, so that the belt loop device can be sewn into a holster or attaché adhesively to a holster. Alternatively, a holster could be made having a belt loop built in. In either configuration; the belt loop can be used for personal carry with the holster over a waist belt. When the holster is inserted into the basket member, the tab "snaps-in" to the slot and holds the holster in the basket. The gun can then be pulled out of the holster without having the holster come out of the basket. Depressing the tab from the front side of the holster allows the holster to be extracted from the basket.

As shown in FIGS. 1 and 2, the basket member (18) may also include fins (44, 46) associated with the hinge pins to inhibit the hinge pins from being pulled out of the hinge barrels when the basket member in a cantilevered position with respect to the plate member. The fins do not inhibit the pins from being pulled out of the hinge barrels when the basket member is rotated into the plane of the plate member. The basket member may also include a stop (48) beneath the hinge pins.

What is claimed:

1. A device for hanging a holstered handgun along a side of a mattress comprising:

a plate member adapted for insertion between an underside of the mattress and a supporting surface below the mattress, wherein the plate member has a side adapted to extend outward from the mattress, and that side of the plate member has a pair of spaced apart hinge barrels each adapted to receive a hinge pin;

a basket member adapted to receive a handgun holster, wherein the basket member has a mattress facing side, two lateral sides and a front side opposite the mattress facing side, wherein the basket member has a hinge pin extending from each lateral side adapted to couple into a hinge barrel on the plate member; and barb projections on the plate member adapted to snag the support surface below the mattress.

2. A device for hanging a holstered handgun along a side of a mattress as in claim 1, further including the plate member having a paddle section.

3. A device for hanging a holstered handgun along a side of a mattress comprising:

a plate member adapted for insertion between an underside of the mattress and a. supporting surface below the mattress, wherein the plate member has a paddle section and a side adapted to extend outward from the mattress, and that side of the plate member has a pair of spaced apart hinge barrels each adapted to receive a hinge pin; and a basket member adapted to receive a handgun holster, wherein the basket member has a mattress facing side, two lateral sides and a front side opposite the mattress facing side, wherein the basket member has a hinge pin extending from each lateral side adapted to couple into hinge barrel on the plate member;

wherein the paddle section has a cutout section corresponding to the profile of the basket member such that the basket member can be packaged within the cutout of the plate member in a blister pack.

4. A device for hanging a holstered handgun along a side of a mattress as in claim 1, further including: the front side of the basket member having a slot for receiving a tab of a handgun holster in an interlocking fit.

5. A device for hanging a holstered handgun along a side of a mattress as in claim 1, in combination with a belt loop device attachable to a holster, the belt loop device having a support panel with a flexible hook extending from a top portion of the panel and a tab extending from a lower portion of the panel, wherein the tab is adapted for interlocking fit into the slot of the basket member.

6. A device for hanging a holstered handgun along a side of a mattress as in claim 5, wherein the belt loop device is adapted for attachment to a soil case holster.

7. A device for hanging a holstered handgun along a side of a mattress comprising;

a plate member adapted for insertion between an underside of the mattress and a supporting surface below the mattress, wherein the plate member has a side adapted to extend outward from the mattress, and that side of the plate member has a pair of spaced apart hinge barrels each adapted to receive a hinge pin;

a basket member adapted to receive a handgun holster, wherein the basket member has a mattress facing side, two lateral sides and a front side opposite the mattress facing side, wherein the basket member has a hinge pin extending from each lateral side adapted to couple into a hinge barrel on the plate member; and fins associated with the hinge pins that inhibit the hinge pins from being pulled out of the hinge barrels when the basket member is a cantilevered position with respect to the plate member but do not inhibit the pins from being pulled out of the hinge barrels when the basket member is rotated into the plane of the plate member.

8. A device for hanging a holstered handgun along a side of a mattress as in claim 1, wherein the hinge pins are integrally formed with the basket member.

9. A device for hanging a holstered handgun along a side of a mattress as in claim 1, wherein each hinge pin is adapted to removably couple into a corresponding one of the hinge barrels on the plate member.

* * * * *